US005273270A

United States Patent [19]

Taketsugu et al.

[11] Patent Number: 5,273,270

[45] Date of Patent: Dec. 28, 1993

[54] DRIVING DEVICE FOR A PLATE-SHAPED BODY FEEDING KICKER

[75] Inventors: Masahiro Taketsugu; Osamu Hatano, both of Hiroshima, Japan

[73] Assignee: Mitsubishi Jukogyo Kabushiki Kaisha, Tokyo, Japan

[21] Appl. No.: 931,350

[22] Filed: Aug. 18, 1992

[30] Foreign Application Priority Data

Sep. 26, 1991 [JP] Japan ..... 3-85958[U]

[51] Int. Cl.[5] ..... B65H 3/24

[52] U.S. Cl. ..... 271/139; 271/144

[58] Field of Search ..... 271/42, 131, 132, 139, 271/142, 144

[56] References Cited

U.S. PATENT DOCUMENTS

| | | | |
|---|---|---|---|
| 928,969 | 7/1909 | Harris | 271/131 |
| 3,804,402 | 4/1974 | Hottendorf | 271/144 |
| 4,008,889 | 2/1977 | Ayres | 271/132 |
| 4,238,125 | 12/1980 | Klietz | 271/131 |
| 4,483,529 | 11/1984 | Watanabe | 271/131 |
| 4,661,091 | 4/1987 | Moen | 271/131 |

FOREIGN PATENT DOCUMENTS

| | | | |
|---|---|---|---|
| 2403600 | 8/1974 | Fed. Rep. of Germany | 271/144 |
| 393796 | 1/1909 | France . | |
| 2215376 | 8/1974 | France . | |
| 53943 | 3/1989 | Japan | 271/131 |

OTHER PUBLICATIONS

European Search Report, The Hague, completed Feb. 26, 1993.

Patent Abstracts of Japan, vol. 10, No. 281 (M-520)(2337), Sep. 25, 1986.

*Primary Examiner*—Robert P. Olszewski

*Assistant Examiner*—Steven M. Reiss

*Attorney, Agent, or Firm*—Rothwell, Figg, Ernst & Kurz

[57] ABSTRACT

In a driving device for a plate-shaped body feeding kicker, a durability of a slide section is improved and mixing of paper powder onto a slide surface can be prevented by supporting a rear end of a screw shaft for moving the kicker by use of a block encompassed by a guide cylinder. In more particular, a front end of a screw shaft for reciprocating a kicker is supported by a slider similarly to the driving device in the prior art, but the rear end of the screw shaft is supported by slidably encompassing a slide piece mounted to the screw shaft by means of a guide cylinder. Especially, the slide piece is held within the guide cylinder as immersed in oil.

5 Claims, 6 Drawing Sheets

DRIVING DEVICE FOR A PLATE-SHAPED BODY FEEDING KICKER

BACKGROUND OF THE INVENTION

1. Field of the Invention

The present invention relates to a driving device for a plate-shaped body feeding kicker which is applicable to a feeding apparatus of sheets (plate-shaped bodies) in a paper sheet working machine, a thin metal sheet working machine or the like, and more particularly to a driving device for a plate-shaped body feeding kicker, which can be favorably equipped in a paper sheet feeding section of a corrugated cardboard box making machine.

2. Description of the Prior Art

At first, a general structure of a driving device for a paper sheet feeding kicker in the prior art will be explained with reference to FIGS. 4 to 6. Also, a construction and function of a conventional paper sheet feeding section equipped in a corrugated cardboard box making machine in the prior art will be explained briefly with reference to FIGS. 7 and 8.

In the heretofore known type of driving device for a paper sheet feeding kicker, as shown in FIGS. 7 and 8, a back stop 19 in a paper sheet feeding section is constructed so that it can be moved back and forth on a paper sheet feeding table 20 by means of a screw shaft 22, and the back stop 19 is adapted to be fixed on the table 20 at an arbitrary position within a range of an adjustable amount W indicated in FIG. 4 in accordance with a length (a width in the feeding direction) of a corrugated cardboard sheet 1 to be fed. On the other hand, corrugated cardboard sheets 1 charged from the preceding step of process would strike against a front guide 21 provided as fixed in position and would fall and stack between the front guide 21 and the above-described back stop 19, then they are sequentially kicked out via a kicker 3 starting from a sheet 1*a* at the lowermost level, and provision is made such that they may be carried out to the next step of process by means of a pair of feed rolls 2*a* and 2*b* equipped at the downstream.

As described above, in this kicker driving device, in view of its functions a structure such that the kicker 3 also can be preset in position by being moved back and force as interlocked with the above-mentioned back stop 19, is employed. Describing the construction of the aforementioned kicker 3 in more detail, a screw block 12 forming a female screw is fixedly secured to the bottom of the kicker 3, and with the same block 12 is threadedly engaged a kicker moving screw shaft 5 arranged so as to be rotated as interlocked with the screw shaft 22 for moving the back stop 19. The opposite ends of this screw shaft 5 are rotatably supported by a slider 4 which can slide along a rail 28 closely to the surface of the table 20, and they can reciprocate in the axial direction as integrated with the slider 4.

To the bottom of the slider 4 is fixedly secured a link receiver 23, to the bottom end of the same link receiver 23 is connected a link 15 via a pin 24, and the other end of the same link 15 is connected via a pin 25 to a tip end of a lever 14 which swings about a fulcrum shaft 26.

In the above-described structure, if the lever 14 is swung via swinging means not shown, then the engaged link 15, link receiver 23 and slider 4 can be reciprocated, and thereby the kicker 3 preset at a predetermined position on the slider 4 can be reciprocated with a predetermined stroke S shown in FIG. 4. A claw at the tip end of the kicker 3 is engaged with the rear end of the lowermost corrugated cardboard sheet 1a in a stack under its initial condition, and at the time of push-out operation, it causes the same sheet 1a to pass through the gap clearance at the bottom of the front guide 21, then after the sheet 1a has been pinched by a pair of feed rolls 2*a* and 2*b*, the claw would retreat and would be engaged with the rear end of the lowermost corrugated cardboard sheet similarly to the initial condition. Thereafter, the same operations are repeated, and the stacked sheets 1 would be carried out one by one to the next step of process with a predetermined sheet interval held therebetween.

Next, description will be made on an adjusting device for the position in the forward and backward direction of the kicker 3 with respect to the slider 4. The kicker 3 is engaged with the screw shaft 5 via a screw block 12 to which the same kicker 3 is fixedly secured, and it moves back and forth in response to rotation of the same screw shaft 5. Rotation of the screw shaft 5 is effected by rotation of a rod 18 which is driven by a motor not shown via various power transmission means.

Here, the engagement between the rod 18 and the rear end of the screw shaft 5 will be explained with reference to FIGS. 5 and 6. An engaging section of the rod 18 is formed in the form of a bar having a nearly square cross-section, butting metals 17 are engaged with the same engaging section, and the same butting metals 17 are mounted respectively onto four adjusting screws 27 threadedly inserted into the rear end portion of the screw shaft 5 from four directions, so that the gap clearances between the rod 18 and the butting metals 17 can be adjusted by means of the same adjusting screws 27. Accordingly, if the same rod 18 is rotated, the screw shaft 5 is rotated via the butting metals 17. The screw shaft 5 is pivotably supported by the slider 4 via a bush 16 fitted as shown in FIG. 5.

Owing to the above-described construction, the kicker 3 can be variably set in position in the back and forth directions with respect to the slider 4 by rotating the rod 18, and it can be adapted to the length of various kinds of sheet 1. At the same time, the kicker 3 can move back and forth integrally with the slider 4 which pivotably supports the screw shaft 5, and hence, a relative position of the kicker 3 with respect to the rod 18 which is provided at a fixed position is made variable. Namely, since the driving device for the kicker 3 of the heretofore known type was constructed and operated in the above-described manner, various problems as will be described later were left intact.

More particularly, as described in the preceding paragraphs, in the kicker driving device in the prior art, because of the fact that a slide surface at the time of reciprocating motion of the kicker was open type, paper powder was liable to enter and adhere to the gap clearances between the rod and the butting metals, hence the slide surface would become short in oil during a short period, and so there was a problem that wear of component parts is remarkable and so frequent inspections and adjustments were necessitated.

SUMMARY OF THE INVENTION

It is therefore a principal object of the present invention to provide an improved driving device for a plate-shaped body feeding kicker, which is free from the above-described shortcomings of the known kicker driving device.

A more specific object of the present invention is to provide a driving device for a plate-shaped body feeding kicker, in which a durability of parts in a sliding portion is enhanced, a necessary frequency of feeding oil is greatly reduced, a work of removing paper powder from a sliding portion becomes unnecessary, and maintenance-free can be realized.

According to one feature of the present invention, there is provided a driving device for a plate-shaped body feeding kicker, including a kicker adapted to butt against stacked plate-shaped bodies for pushing out a plate-shaped body at the lowermost level, a screw shaft for adjusting the position of the same kicker in the direction of movement and also for giving reciprocating motion to the same kicker to push out the above-mentioned plate-shaped body, and drive means for giving reciprocating motion to the same screw shaft, in which a front side of the aforementioned screw shaft is supported by a freely reciprocatable slider, and a rear side of the above- mentioned screw shaft is fixedly secured to a slide piece which can freely reciprocate along a guide.

According to another feature of the present invention, there is provided the above-featured driving device for a plate-shaped body feeding kicker, in which the above-mentioned guide is connected to an externally rotatable rod so that the above-described guide can be rotated by the same rod, rotation of the same guide is transmitted to the aforementioned screw shaft via the above-mentioned slide piece, and thereby the position of the above-mentioned kicker in the direction of movement can be adjusted.

According to still another feature of the present invention, there is provided the above-featured driving device for a plate-shaped body feeding kicker, in which a swing lever forming the above-described drive means is connected to the aforementioned slider, and thereby reciprocating motion of the screw shaft for pushing out the above-mentioned plate-shaped body is given.

According to yet another feature of the present invention, there is provided the above-featured driving device for a plate-shaped body feeding kicker, in which the above-described guide is accommodated within a housing having the aforementioned screw shaft penetrated therethrough, oil is reserved within the same housing, and thereby a slide portion between the aforementioned guide and the aforementioned slide piece is lubricated.

In other words, the present invention proposes to apply the following technical device to the heretofore known kicker driving device. That is, support for the front side of the screw shaft for moving a kicker back and forth by a distance corresponding to the length of the plate-shaped body is constructed as support by a slider similarly to the heretofore known system, but support for the rear side is constructed as a slide section, in which a slide piece fixedly secured to the screw shaft is made to reciprocate along a guide. The slide section for guiding the slide piece is formed as a cylinder (grease- or oil-reservoir) structure, and the slide piece is immersed in oil. In addition, by employing the technical device that the rear end portion of the above-mentioned screw shaft is positioned by making use of a bearing which allows movement in the axial direction and a guide cylinder encompassing a slide block, the above-described problems involved in the kicker driving device in the prior art can be resolved.

In summary, according to the present invention, in a support structure of a screw shaft for reciprocating a kicker back and forth by a distance corresponding to a length of a plate-shaped body, which is used in a driving device for a plate-shaped body feeding kicker, the front side of the above-mentioned screw shaft is pivotably supported by means of a slider that can reciprocate in the back and forth directions, while the rear side of the same screw shaft is pivotably supported by being fixedly secured to a slide piece that can reciprocate along a guide, and thereby the problems involved in the prior art can be resolved. In addition, according to the present invention, the slide piece fixedly secured to the rear end portion of the above-described screw shaft is immersed in oil within the guide section, hence the slide section can be continuously lubricated, and the driving device can operate in a maintenance-free fashion.

According to the present invention, owing to the above-described structural features, a slide surface area at the time of operation (sheet kick-out operation) of a kicker can be enlarged, and thereby a contact pressure perunit area of the slide surface can be reduced, resulting in reduction of wear of the slide surfaces. Furthermore, on the rear side of the screw shaft, in the slide section consisting of a slide piece and a guide, a continuously oiled condition can be maintained (sustained), and also, on the slide surface, mixing and adhesion of paper powder dropped out from the sheets can be prevented. Furthermore, adjustment of a gap clearance in the slide section can be made unnecessary.

The above-mentioned and other objects, features and advantages of the present invention will become more apparent by reference to the following description of one preferred embodiment of the present invention taken in conjunction with the accompanying drawings.

DESCRIPTION OF THE PREFERRED EMBODIMENT

Figure 1:
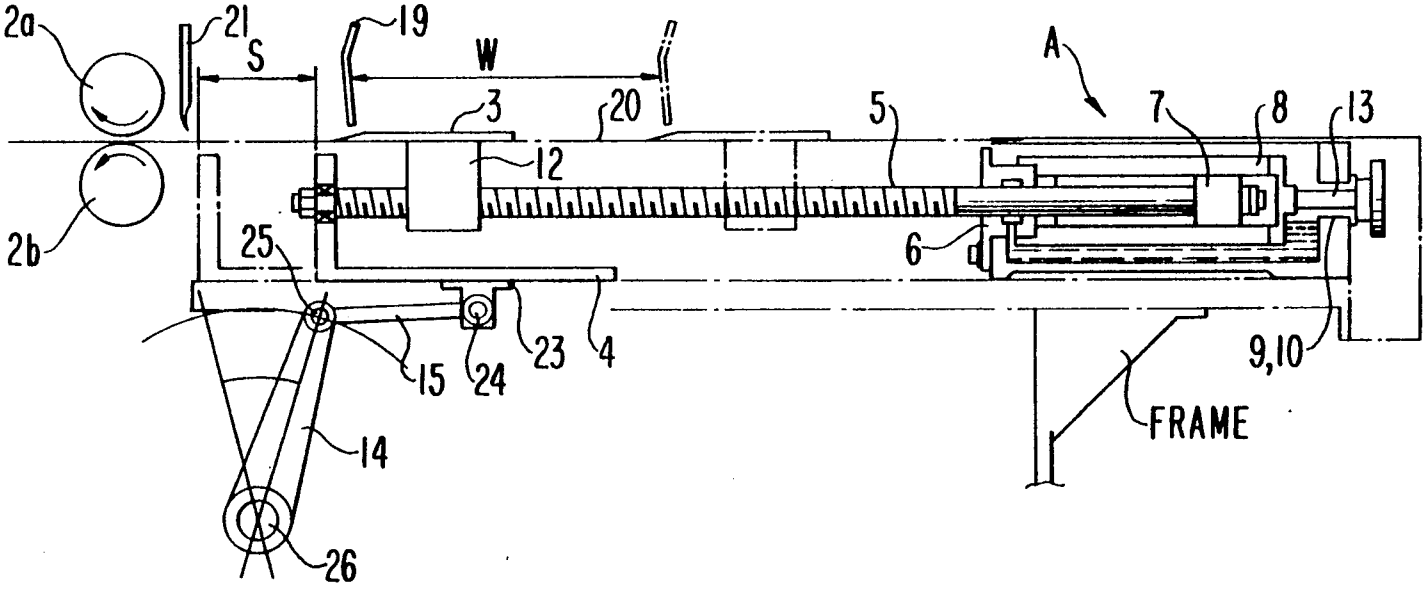
FIG. 1 is a side view partly in cross-section of a driving device for a paper sheet feeding kicker in a corrugated cardboard box making machine showing one preferred embodiment of the present invention.
Figure 2:
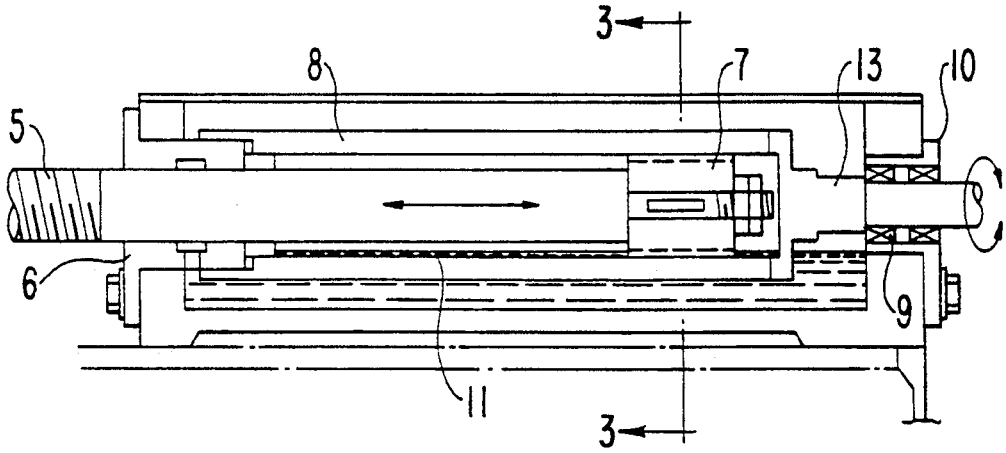
FIG. 2 is a detailed cross-section view of a portion marked A in FIG. 1.
Figure 3:
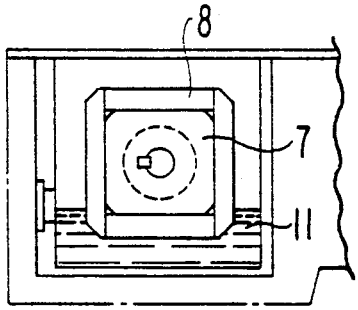
FIG. 3 is a transverse cross-section view taken along line B—B in FIG. 2 as viewed in the direction of arrows.
Figure 4:
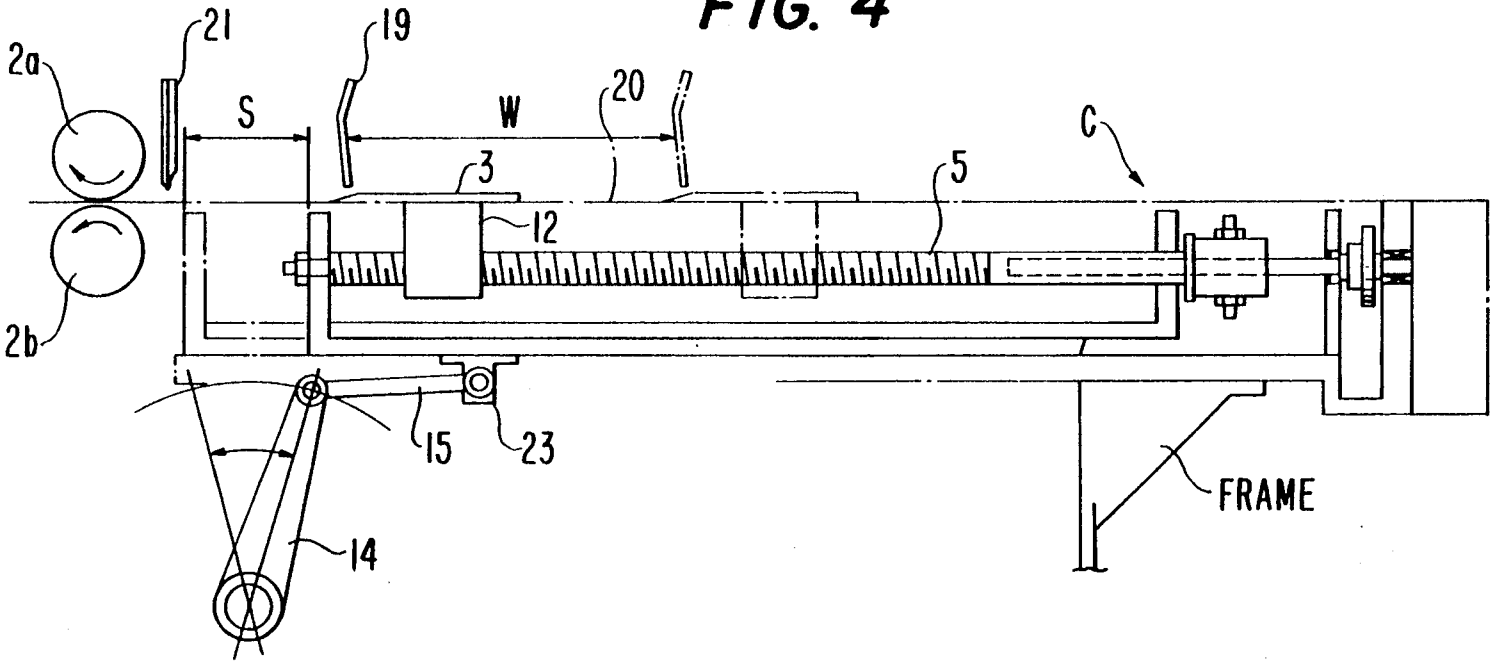
FIG. 4 is a side view partly in cross-section of a driving device for a paper sheet feeding kicker in a corrugated cardboard box making machine in the prior art.
Figure 5:
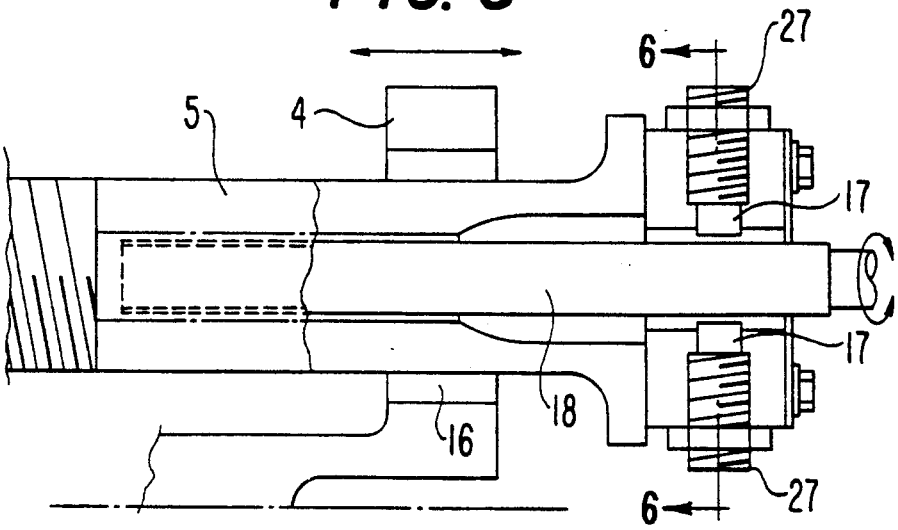
FIG. 5 is a detailed cross-section view of a portion marked C in FIG. 4.
Figure 6:
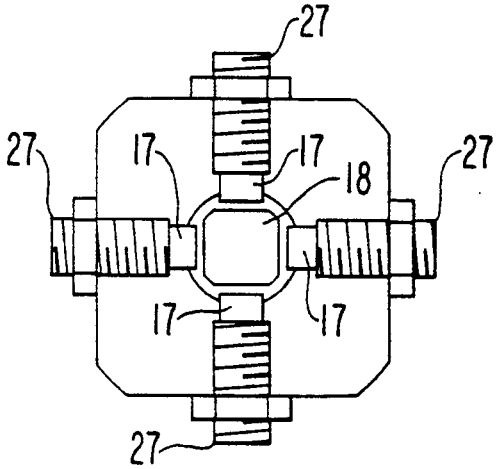
FIG. 6 is a transverse cross-section view taken along line D—D in FIG. 5 as viewed in the direction of arrows.
Figure 7:
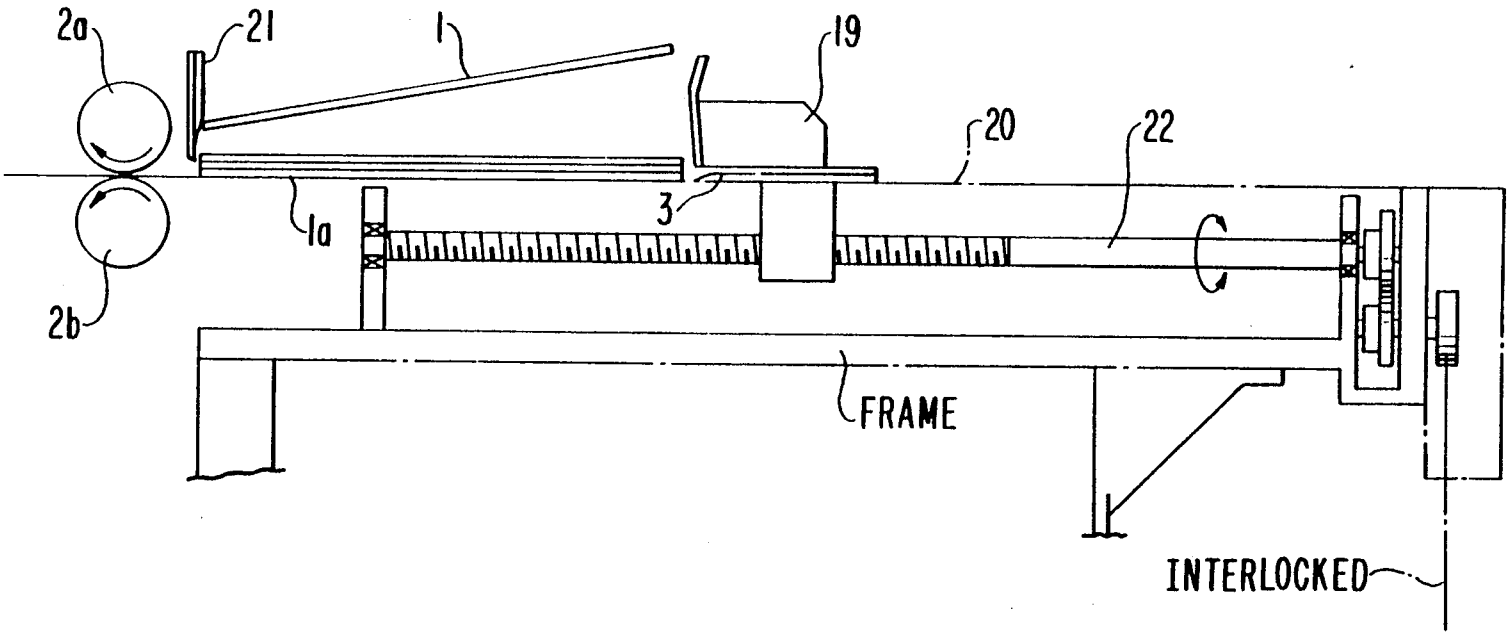
FIG. 7 is a schematic side view of a conventional paper sheet feeding section equipped in a corrugated cardboard box making machine in the prior art showing a mechanism for adjustably moving a back stop.
Figure 8:
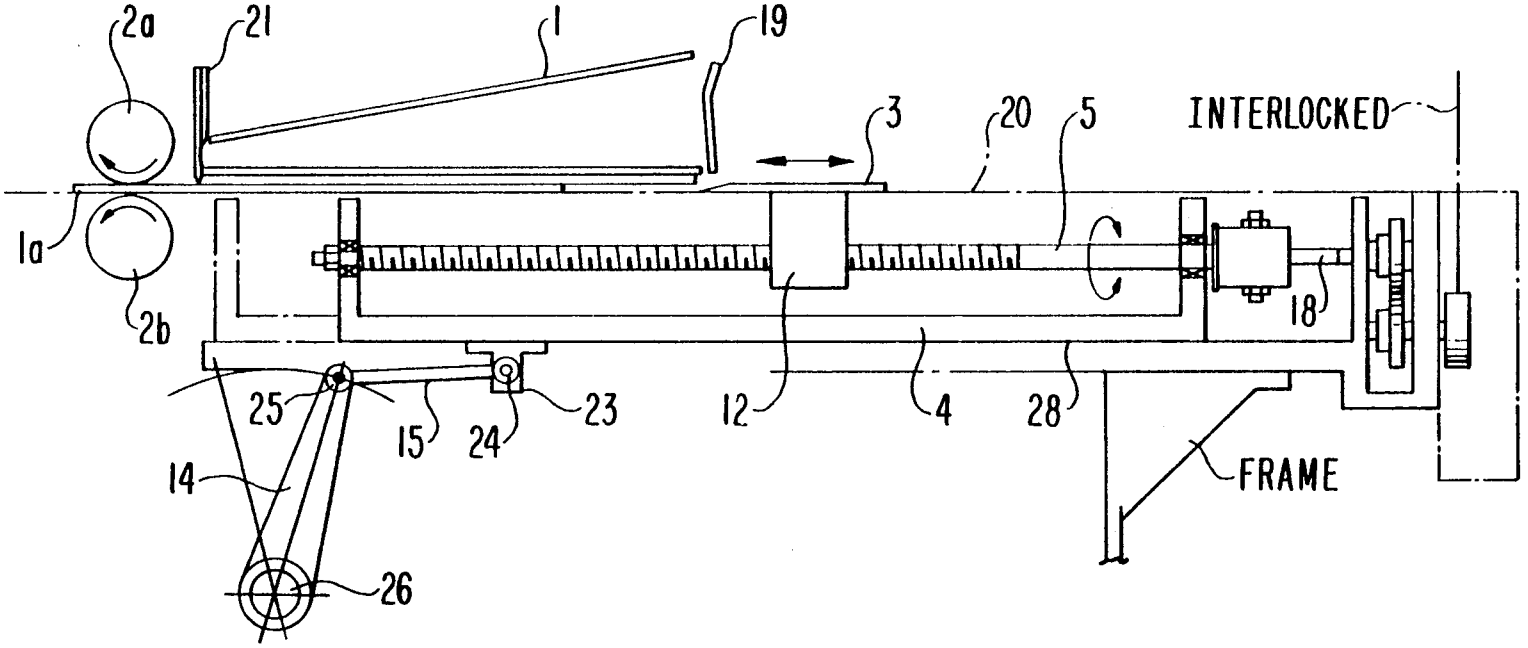
FIG. 8 is another schematic cross-section side view of a conventional paper sheet feeding section equipped in a corrugated cardboard box making machine in the prior art showing a mechanism for reciprocating a kicker jointly with a slider.

In the preferred embodiment illustrated in FIGS. 1 to 3, a driving device for a sheet-shaped body feeding kicker according to the present is applied to a paper sheet feeding device in a corrugated cardboard box making machine.

In this kicker driving device, the function of a kicker 3 of kicking out corrugated cardboard sheets 1 stacked in a paper sheet feeding section one by one starting from the sheet at the lowermost level and conveying them sequentially to the step of process at the downstream via a pair of feed rolls 2, is similar to that explained in the preceding paragraphs relating to the prior art. The present invention is characterized by the method of adjusting the position of the kicker 3 with respect to a slider 4, and the structure of the device for reciprocating the kicker 3. The construction and function of the invention will be explained in more detail in the following.

In the preferred embodiment of the present invention shown in FIG. 1, a front end of a screw shaft 5 for moving a kicker is pivotably supported by a slider 4 similarly to the structure in the prior art, and a part of a rear end portion is pivotably supported by a bearing 6 which is allowed to slide in the axial direction. Also, to the rearmost end portion of the same screw shaft 5 is fixedly secured a block 7 having a square-shaped cross-section and serving as a slide piece, and the same block 7 is accommodated within a guide section, that is, is encompassed by a guide cylinder 8. One end of the guide cylinder 8 is pivotably supported from a main body frame via a bearing 9 and a housing 10. It is to be noted that in the interior of the above-mentioned guide cylinder 8 is sealingly enclosed an appropriate amount of oil (grease) 11, and hence the block 7 is kept immersed in oil.

In the opposite end portion of the guide cylinder 8, oil communication holes are formed at four locations above and below and on the left and right as seen in FIG. 3, so that an oil level within the guide cylinder 8 may be maintained constant as a result of in-flow and out-flow of the oil 11 between the guide cylinder 8 and the housing 10 when the block 7 reciprocates within the guide cylinder 8.

Next, description will be made on the method of presetting the position in the back and forth directions of the kicker 3 with respect to the slider. The kicker 3 is engaged with a screw shaft 5 via a screw block 12 fixedly secured to the kicker 3, and it is adapted to be moved back and forth within an adjustable range W by rotating the same screw shaft 5. Rotation of the screw shaft 5 is effected by rotating the guide cylinder 8 fixedly secured to a shaft 13 as a result of rotation of the shaft 13 driven by a motor not shown via power transmission means, and by the intermediary of the block 7 encompassed by the guide cylinder 8. As described above, the forward and backward (reciprocating) motion of the kicker 3 preset at a predetermined position on the screw shaft 5 having a magnitude of stroke S, is carried out by a swing motion of a lever 14 via a link 15, a link receiver 23 and a slider 4 similarly to the above-described driving device in the prior art. In this construction, a slide section at the rear end of the screw shaft 5 is composed of the portion between the bearing 6 and the screw shaft 5 and the portion between the guide cylinder 8 and the outer circumferential surface of the block 7 engaged with the guide cylinder 8.

The above-described preferred embodiment is characterized in that the rear end of the sliding screw shaft 5 is supported by the block 7, also the same block 7 is kept immersed in oil, and an area of slide contact is enlarged, thereby delicate gap clearance adjustment between the butting metals 17 and the rods 18 as required in the prior art can be made unnecessary, and furthermore, various effects and advantages such as enhancement of anti-abrasion property at the sliding section, easiness of assembly and adjustment and the like, can be expected.

As will be apparent from the detailed description of the preferred embodiment above, with the driving device for a plate-shaped body feeding kicker according to the present invention, since the device is held in a continuously oiled condition, a durability of parts in the sliding section is increased, a frequency of feeding oil is greatly reduced, the work of removing paper powder on the sliding surface becomes unnecessary, and a maintenance-free operation can be realized. In addition, excellent effects and advantages such that owing to unnecessity of gap clearance adjustment an assembling time can be reduced, and assembly not relying upon skill of an assembling worker can be realized.

In connection to the configuration of the component parts and other factors, the present invention should not be limited only to the above-described embodiment but many changes and modifications could be made to the illustrated embodiment without departing from the spirit of the present invention.

What is claimed is:

1. A driving device for a plate-shaped body feeding kicker including a kicker adapted to butt against stacked plate-shaped bodies for pushing out a plate-shaped body at the lowermost level, a screw shaft for adjusting the position of said kicker in the direction of movement and also for giving reciprocating motion to said kicker to push out said plate-shaped body, a front side of said screw shaft is supported by a freely reciprocatable slider, and a rear side of said screw shaft is fixedly secured to a slide piece which can freely reciprocate along a guide, and drive means for giving reciprocating motion to said screw shaft, in which said guide is accommodated within a housing having said screw shaft penetrated therethrough, oil is reserved within the same housing, and thereby a slide portion between said guide and said slide piece is lubricated.

2. A driving device for a plate-shaped body feeding kicker, including a kicker adapted to butt against stacked plate-shaped bodies for pushing out a plate-shaped body at the lowermost level, a screw shaft for adjusting the position of said kicker in the direction of movement and also for giving reciprocating motion to said kicker to push out said plate-shaped body, a front side of said screw shaft is supported by a freely reciprocatable slider, and a rear side of said screw shaft is fixedly secured to a slide piece which can freely reciprocate along a guide, and drive means for giving reciprocating motion to said screw shaft, in which said guide is connected to an externally rotatable rod so that said guide can be rotated by said rod, rotation of said guide is transmitted to said screw shaft via said slide piece, and thereby the position of said kicker in the direction of movement can be adjusted.

3. A driving device for a plate-shaped body feeding kicker as claimed in claim 2, in which a swing lever forming said drive means is connected to said slider, and thereby reciprocating motion of the screw shaft for pushing out said plate-shaped body is given.

4. A driving device for a plate-shaped body feeding kicker as claimed in claim 2, in which said guide is accommodated within a housing having said screw shaft penetrated therethrough, oil is reserved within the same housing, and thereby a slide portion between said guide and said slide piece is lubricated.

5. A driving device for a plate-shaped body feeding kicker, including a kicker adapted to butt against stacked plate-shaped bodies for pushing out a plate-shaped body at the lowermost level, a screw shaft for adjusting the position of said kicker in the direction of movement and also for giving reciprocating motion to said kicker to push out said plate-shaped body, a front side of said screw shaft is supported by a freely reciprocatable slider, and a rear side of said screw shaft is fixedly secured to a slide piece which can freely reciprocate along a guide, and drive means for giving reciprocating motion to said screw shaft, in which a swing lever forming said drive means is connected to said slider, and thereby reciprocating motion of the screw shaft for pushing out said plate-shaped body is given, and further wherein said guide is accommodated within a housing having said screw shaft penetrated therethrough, oil is reserved within the same housing, and thereby a slide portion between said guide and said slide piece is lubricated.

* * * * *